United States Patent [19]

Sutliff

[11] Patent Number: 4,524,838

[45] Date of Patent: Jun. 25, 1985

[54] OIL WELL JAR

[75] Inventor: Wayne N. Sutliff, Bakersfield, Calif.

[73] Assignee: Jim L. Downen, Bakersfield, Calif.

[21] Appl. No.: 437,196

[22] Filed: Oct. 13, 1982

[51] Int. Cl.[3] ..... E21B 4/14

[52] U.S. Cl. ..... 175/297

[58] Field of Search ..... 175/297, 296, 293, 300

[56] References Cited

U.S. PATENT DOCUMENTS

| | | | |
|---|---|---|---|
| 3,729,058 | 4/1973 | Roberts | 175/297 |
| 3,949,821 | 4/1976 | Raugust | 175/297 |
| 4,109,736 | 8/1978 | Webb et al. | 175/297 |
| 4,179,002 | 12/1979 | Young | 175/297 |
| 4,346,770 | 8/1982 | Beck | 175/297 |

*Primary Examiner*—James A. Leppink
*Assistant Examiner*—Hoang C. Dang

[57] ABSTRACT

A jar for use in imparting jarring blows to an object lodged in the bore of a well. The jar includes a mandrel member and outer telescopically related tubular member, the mandrel member and said tubular member being telescopically movable between an extended and a collapsed position of the jar. One of the members is connected to a drill string while the other of the members is connected to the object to be jarred. Telescopically overlapping portions of the members provide an annular chamber for confining an operating fluid. A sleeve and a cylinder extend into the chamber and into an essentially fluid tight fit with each other for a selected portion of the telescopic travel between the extended and collapsed positions. An operating fluid bypass is provided in the first one of the members, the bypass being in fluid communication with the operating fluid above and below the sleeve, the bypass including a channel. An orifice is disposed in the channel. A filter, distinct from said orifice, is provided by controlling the clearances between the sleeve and the first one of the members.

17 Claims, 13 Drawing Figures

FIG. 1
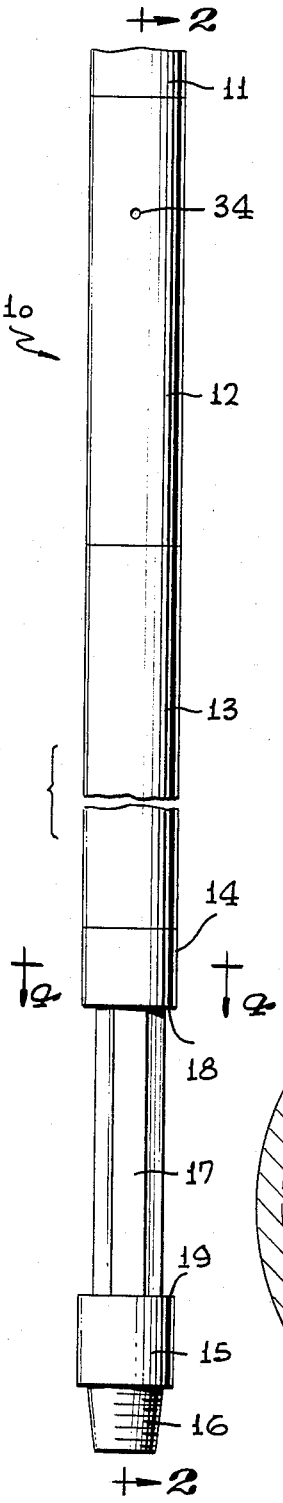
FIG. 3a
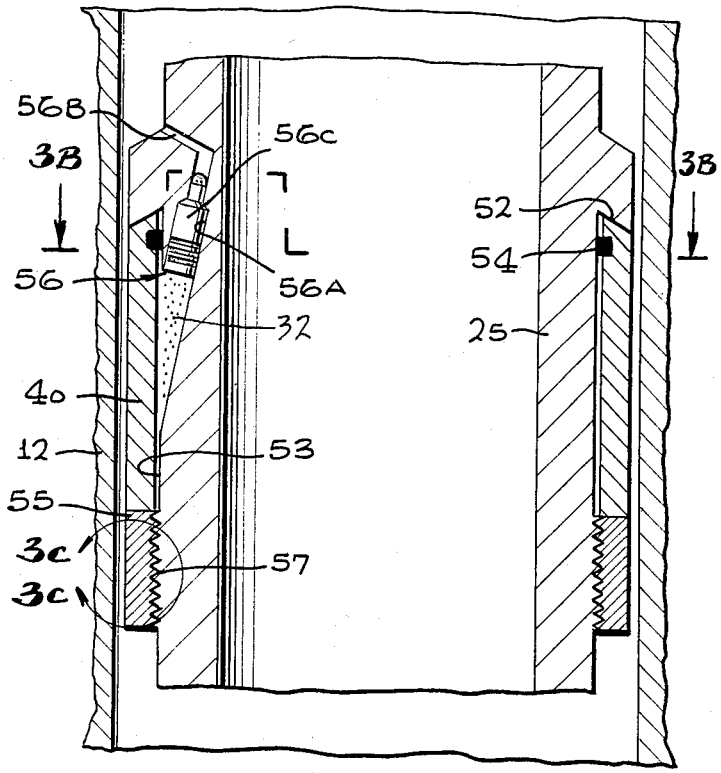
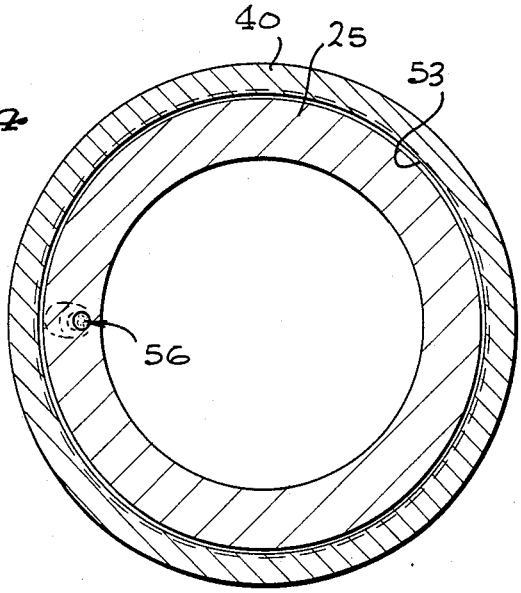
FIG. 3B
FIG. 3c
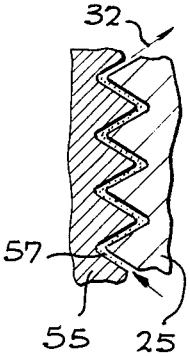

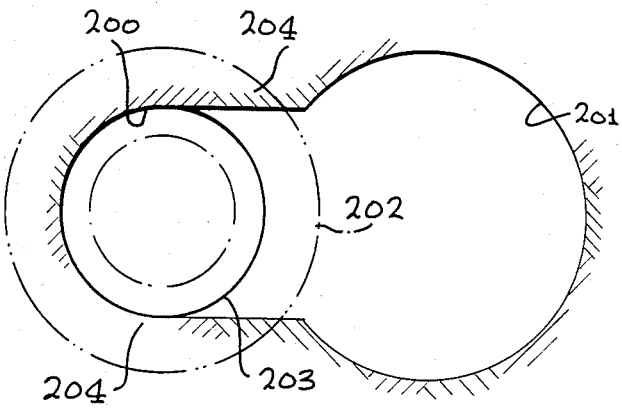
FIG. 5
FIG. 4
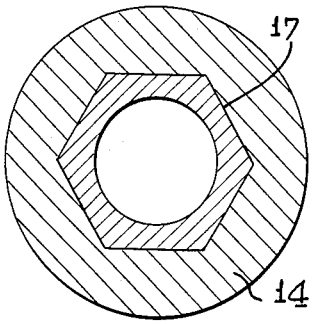
FIG. 6a
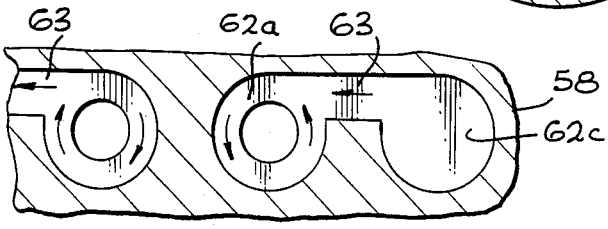
FIG. 6b
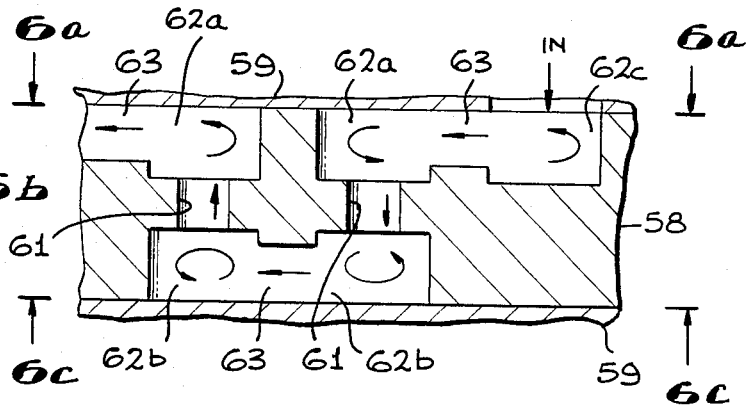
FIG. 6c
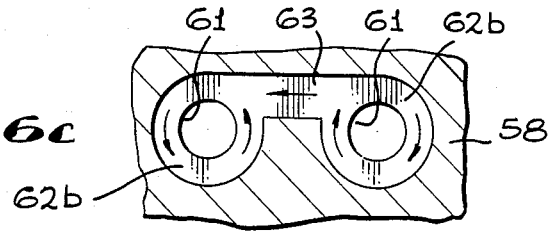

OIL WELL JAR

TECHNICAL FILED

The present invention relates to jars of a type which are used in drilling wells, particularly oil wells. A jar is a device which is used to help withdraw the tools usually disposed at the end of a drill string when such tools become lodged at a knee in the bore of the well.

BACKGROUND OF THE INVENTION

Prior art jars are disclosed by U.S. Pat. Nos. 2,989,132 and 4,261,427. The jars disclosed in my prior U.S. patents permit an upward jarring, snap action blow to be administered to the lodged tools in the drilled bore of a well by stretching the drill string, the jar thereafter releasing and permitting the recoiling drill string to impose an upward jarring blow to the tools through the jar. While my prior jars fulfill this requirement well, the time at which the upward jarring blow is administered to the lodged tools is affected by not only environmental factors but also the stress in the drill string imposed by the drill rig operator. The environmental factors include the viscosity of the oil used in the jar, the temperature of that oil and the state of wear of the jar. The jar of the present invention includes design features which make it essentially immune to environmental conditions such as the temperature of the jar in the well.

BRIEF DESCRIPTION OF THE INVENTION

Briefly, my improved jar comprises a mandrel about which is disposed a tubular element which telescopically moves with respect to the mandrel. The tubular element is connected at its upper end to the drill string while the lower end of the mandrel is connected to the object to be jarred. The telescopically overlapping portions of the outer element and the mandrel define an annular chamber in which is confined an operating fluid. A sleeve is disposed on the mandrel which extends radially outwardly therefrom into the chamber and a cylinder is formed on the inner wall of the tubular element extending radially inwardly into the chamber and into close fitting relationship with the sleeve when the mandrel and the tubular element are telescopically positioned such that the sleeve and cylinder are in a confronting relationship. An operating fluid bypass is provided for controlling the bypass of the operating fluid around the sleeve-cylinder interface when the sleeve and cylinder are in confronting relationship. The bypass includes an orifice fitting, which in a preferred embodiment of invention, includes spin chambers for spinning the operating fluid therein, the spin chambers being connected by both axial and tangentally arranged fluid passageways. Preferably, the sleeve is held in place by a nut which is threaded on the mandrel, the threads engaging the nut and mandrel being selected to provide a filtering fluid passageway which communicates with the orifice fitting disposed radially inwardly of the sleeve in the bypass.

BRIEF DESCRIPTION OF THE DRAWINGS

The novel features believed characteristic of the invention are set forth in the appended claims. The invention itself, however, as well as a preferred mode of use, and additional objects and advantages thereof, will be best understood by reference to the following detailed description of an illustrative embodiment when read in connection with the accompanying drawings, wherein:

FIG. 1 is a side elevational view of an oil well jar;

Figures 2A, 2B, 2C, 2D:
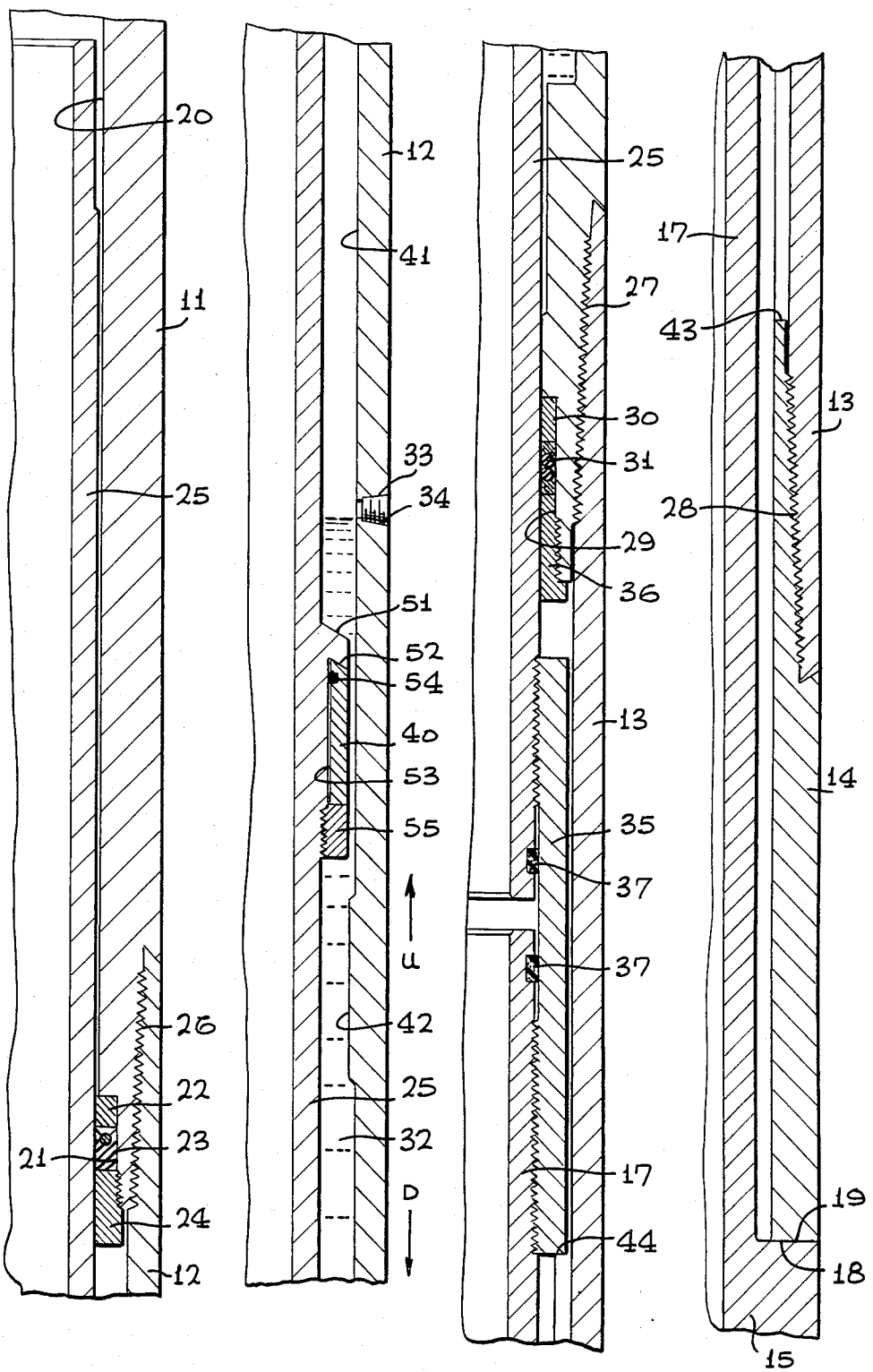

FIGS. *2a–2d* form a quarter sectional view of the jar, the section being indicated at 2—2 in FIG. 1;

FIG. *3a* is an enlarged side sectional view of the jar in the vicinity of the sleeve on the mandrel;

FIG. *3b* is a horizontal sectional view through the sleeve area on the mandrel taken at *3b—3b* in FIG. *3a;*

FIG. *3c* is a detailed view of the thread innerface between nut 55 and the mandrel;

FIG. 4 is a sectional view taken as shown at 4—4 in FIG. 1;

FIG. 5 depicts a keyhole slot which may occur when drilling deep wells through the earth; and FIGS *6a*, *6b* and *6c* are top, side sectional, and bottom views of a portion of the orifice fitting.

DETAILED DESCRIPTION OF THE PREFERRED EMBODIMENT

FIG. 1 is a side elevational view of an oil well jar 10 of the type embodying in the present invention. The jar preferably includes a top sub 11 having an internally threaded box (not shown) with which the jar 10 may be united with the bottom pin of a drill string to permit the jar to be suspended on the end of the drill string.

Connected to the top sub 11 is an upper tubular member on section 12 which, in turn, is connected to a lower tubular member on section 13. The lower end of lower section 13 is attached to a female hex splined sub 14. As can be seen from FIG. 4, sub 14 is provided with a hexagonal spline bore for receiving a hexagonal spline male sub 17 which is preferably intergrally connected to a lower pin 15. The lower pin 15 has a threaded connection 16 to engage the tools which are to be retreaved using jar 10.

FIG. 5 depicts a keyhole slot 200 which occasionally occurs when drilling deep wells. The originally drilled bore is shown at 201. The section comprising this view is taken along a horizontal plane which passes through the knee of a "dog's leg" well bore wherein the upper initially drilled portion drifted at an angle from vertical and, following an effort to correct this, drifted to the opposite direction away from vertical in a lower section of the bore 201. A problem occurs when the drilling rig operator attempts to withdraw the tools 202 from the dog leg bore 201. The drill string 203, having a smaller diameter than that of the tools 202, cuts a narrow vertical keyhole slot 200 to the side of the original bore 201. Of course, the keyhole slot 200 includes a pair of narrowly spaced shoulders 204 which obstruct the upward withdrawl of the drill string 203 and the tools 202 through the keyhole slot 200 in the well bore. The tools 202 frequently become lodged in the bore at the dog's leg and such lodged tools are typically referred as a "fish" in this art.

To retrieve the lodged tools, the practice has been to run a jar 10 in the string 203 to loosen the tools 202 from the keyhole slot 200 by administering upward jarring blows to the tools.

Drillers have found it useful in jarring operation to occasionally alternate successive upward jarring blows with a downward snap-action blow against the fish. To deliver the downward snap-action blow, drillers have developed a technique known as "spudding" in the jar. To deliver the upward blow to the fish, the driller withdrawls the the drill string and, as will be seen, an upward snap-action blow is administered to the fish through the mechanism of the jar. As soon as this action is concluded, the driller then suddenly drops the upward end of the drill string about two-thirds of the total upward stretch required for the upward jarring blow and then resumes support of the drill stem. This "spudding" operation snaps the lower end of the drill string downwardly with a rapid and powerful blow which is transmitted through the jar. This collapses the jar quickly and administers a terrific blow to the fish as the drill string stretches in response to the sudden support. When fully collapsed, impact face 18 on the female hexagonal spline sub 14 is in face to face engagement with impact face 19 of lower pin 15.

As previously mentioned, jars of the type described with reference to FIGS. 1, 4 and 5 are disclosed in my U.S. Pat. Nos. 2,989,132 and 4,261,427. The invention disclosed herein is an improvement to such prior art jars.

FIGS. *2a*, *2b*, *2c*, and *2d* provide a composite quarter sectional view of the jar of FIG. 1. The jar 10 of FIG. 1 is shown in its extended position whereas the jar 10. of FIGS. 2–*2d* is depicted in its collapsed position with impact faces 18 and 19 in face to face engagement. Referring now to FIGS. 2–*2d*, top sub 11 preferably has a counter bore 20 extending downwardly therein to an annular inner recess which is threaded at its lower end. In the recess there is disposed an annular backing ring 22 and a seal 23 both of which are captured in place by an annular threaded ring 24 which threadedly engages top sub 11 at its lower end. The seal 23 sealingly engages a mandrel member 25 which reciprocates in counter bore 20 when the jar 10 is operated.

Upper tubular section 12 is preferably connected to top sub 11 by means of threads 26. Lower tubular section 13, in turn, preferably is connected to upper tubular section 12 by means of threads 27 while female hexagonal spline sub 14 preferably is attached to lower tubular section 13 by means of threads 28.

The lower end of upper tubular section 12 preferably is turned down to provide an annular internal seat 29 for receiving an annular ring 30 and an annular ring ring 31 which are retained in place by an annular threaded ring 36 which threadingly engages the lower end of upper tubular section 12.

The jar 10 is partially filled with hydraulic oil means of a threaded plug 34. Seals 23 and 31 keep the hydraulic oil within the jar from leaking past the mandrel 25 as it reciprocates within the jar. The mandrel 25 is connected to the male hexagonal spline sub 17 preferably by means of a threaded nut 35. The lower end of the mandrel 25 as well as the upper end of sub 17 may be provided with annular O-ring seal 37 engaging nut 35. As can be seen from the figures, sub 17 reciprocates with mandrel 25 as the jar is utilized.

In order to deliver an upward jarring blow, the drill string 203 is withdrawn from the well by the rig operator. Inasmuch as the mandrel 25 is firmly connected to the fish by means of lower pin 15, sub 17, and nut 35, the tubular sections 12 and 13 move in the direction denoted by arrow U relative to mandrel 25 and sub 17 when an upward jarring blow is to be delivered to the fish. The mandrel 25 is permitted to move relatively easily with respect to tubular sections 12 and 13 during all but a small portion of its relative movement therewith. This is due to the fact that there is usually ample space between a sleeve or collar 40 which is attached to mandrel 25 and inner wall 41 of tubular section 12 to permit free passage of the hydraulic oil 32 around sleeve 40 as the mandrel reciprocates within tubular section 12. Upper tubular portion 12 is provided with a cylinder 42 which is perferably integrally formed therewith. The internal diameter of cylinder 42 is sized to snugly fit sleeve 40, the clearance between sleeve 40 and cylinder 42 preferably being on the order of 0.0005 inches. As tubular section 12 moves in direction U with respect to mandrel 25, it will move freely from the collapsed position for only a very short distance until sleeve 40 engages cylinder 42. At this point relative movement between mandrel 25 and tubular section 12 essentially comes to a halt. As will be seen, some movement is permitted due to the controlled bypass of hydraulic fluid around sleeve 40. While this is happening, the drill rig operator continues to withdraw a drill string, causing it to stretch. Tremendous forces are imposed both in the drill string and the jar. The controlled leakage previously mentioned continues until sleeve 40 clears cylinder 42 thereby again permitting relatively free movement of the mandrel 25 with respect to tubular section 12. Of course, at this point there is a large amount of stored energy in the stretched drill string which is released as the drill string 203, sub bar 11, tubular sections 12 and 13 and sub 14 all recoil upwards, delivering a tremendous upward jarring blow to the fish when impact surface 43 on the female hexagonal spline sub 14 meets an impact receiving surface 44 at the lower end of nut 35.

Thereafter the jar can be collapsed by lowering the drill string with or without imparting a substantial blow to the fish depending on whether the rig operator elects to "spud" the jar. The operator has this control because the cavity between the mandrel and the cavity between the mandrel and tubular section 12 is only partially filled with hydraulic oil 32. As collar 40 on mandrel 25 engages cylinder 42 when the tubular section 12 moves in direction D with respect to mandrel 25, there is no need to force hydraulic fluid around the collar 40/cylinder 42 interface. The air above hydraulic oil is merely compressed while a vacuum is drawn on a lower side of the interface. While the force caused by having to compress the air above the innerface and draw the vacuum below the interface is measurable, it is unimportant when compared with the tremendous forces which are imposed on the drill string by the rig operator. Thus, the jar 10 can be easily collapsed by merely lowering the drill string. Whether or not a blow is then delivered to the fish depends on how the rig operator chooses to lower the string.

Turning now to FIGS. *3a* and *3b*, there are depicted an enlarged side sectional and horizontal sectional views of the sleeve 40/cylinder 42 interface. As previously mentioned, controlled bypass of hydraulic fluid is permitted around this interface.

The sleeve 40 is preferably manufactured of beryllium copper while upper tubular section 12 and the other major components of the jar are preferably manufactured from a high strength iron alloy. While the materials used are a matter of design choice, I prefer to use beryllium copper for the sleeve 40 because it has good sealing and antigalling characteristics with respect to iron alloys.

During its manufacture, mandrel 25 is provided either by swedging, machining, or welding, or by a combination of these arts, with an external annular enlargement 51 of the outer surface thereof. The enlargement is machine finished to provide among other things a band of male threads 57 based on the normal exterior diameter of the mandrel 25.and rising above that diameter just by the amount of the depth of the threads. An upper end portion of the annular enlargement 51 is machined to provide an undercut annular stop shoulder 52 and a cylindrical sleeve receiving surface 53 located between shoulder 52 and the male threads 57. For reasons which will become clear, the inside diameter of sleeve 40 and the outside diameter of sleeve receiving surface 53 are sized such that there is a 0.002± 0.0005 inch clearance therebetween which is exaggerated in FIGS. 3*a* and 3*b*. The sleeve 40 preferably includes an O-ring receiving groove 54 having an O-ring therein. The sleeve 40 is captured in place on the receiving surface 53 by means of a threaded fastener such as internally threaded nut 55 The threads on the nut 55 and the threads on the mandrel 25 are selected so that they have preferably a class 3 or 4 fit.

The engaging surfaces of shoulder 52 and sleeve 40 are preferably disposed at a 15 degree downward angle to their common axis. The sleeve 40 is firmly seated on the shoulder 52 by means of nut 55 to prevent the sleeve from cracking due to high pressure hydraulic oil which, as will be seen, will be found between sleeve receiving surface 53 and sleeve 40 when tubular section 12 is moving in direction U and cylinder 42 engages sleeve 40. The nut 55 preferably is locked in place by means of a snap ring (not shown) which is installed in a snap ring groove (also not shown) cut in the mandrel adjacent to the nut 55 after the nut 55 is made up tightly to sleeve 40.

The mandrel includes a hydraulic fluid bypass 56. Those skilled in the art will note from the embodiment disclosed in the drawings, that the passageway for the bypass may be formed by drilling a hole 56*a* at a slight angle to the axis of the mandrel upwardly from a point on the sleeve receiving surface 53 approximately midway along its axial length. A second hole 56*b* is then drilled from just above the enlargement 51 on the mandrel to the distal end of hole 56*a*. Hole 56*a* is sized to receive a Lee Visco Jet (tm) orifice fitting 56*c*. Lee Visco Jets are manufactured by the Lee Company of Pettipaugh Rd., Westbrook, Conn. 06498. It has been found that LeeVisco Jet part numbers VDCA1835401H and VDCA1825800H are suitable for the present application. The first mentioned orifice fitting provides for slower bypass of hydraulic oil than the second mentioned orifice fitting.

The aforementioned orifices fitting 56*c* includes an external filter screen which is preferably removed using any convenient hand tool prior to insertion in hole 56*a*. If the external screen is not removed, it may be deformed under the tremendous operating pressures of the jar.

Due to the relatively dirty working environment of the jar, contaminants can work themselves past seals 23 and 31 and into the hydraulic fluid 32. Also, due to working the jar, normal wear products will also mix with the hydraulic fluid 32. These contaminants and wear products, if not filted, can clog the orifice fitting 56*c* and thereby interfere with the normal operation of the jar. How these contaminants and wear products are filtered is discussed hereafter.

During operation high pressure hydraulic fluid passes through fitting 56*c* by first entering hole 56*a* and thereafter exiting hole 56*b*. As can be seen from FIG. 3*a*, before the hydraulic oil 32 can enter hole 56*a* it first leaks through the threads 57 between the mandrel 25 as is schematically depicted by FIG. 3*c*. Alternatively, means could be provided to permit the fluid to leak past the nut 55/sleeve 40 joint. However, I prefer sizing the threads 56*c* to permit the hydraulic oil 32 to leak in the clearance between the male and female threads as I believe better filtering action results. In any event, the hydraulic oil 32 must then also flow in the narrow gap between the inner surface of collar 40 and the outer surface of collar receiving surface 53. By sizing the collar receiving surface 53, collar 40 and nut 55 with the clearances and thread fits heretofore mentioned, these elements will sufficiently filter the hydraulic fluid so as to minimize the possibility of the orifice fitting 56*c* being clogged with contaminants or wear products. While the nominal radial clearance between sleeve 40 and sleeve receiving surface 53 is only 0.002 inch, the clearance area is sufficient to handle the required fluid flow.

The Lee Visco Jet orifice fitting 56*c* is designed to provide a relatively constant fluid flow rate independent of the pressure differential and the viscosity of fluid. Turning to FIGS. 6*a*–6*c*, there is depicted an orifice plate from a Lee Visco Jet orifice fitting. The Lee Visco Jet orifice provides a group of orifices 61 in series, each individual office 61 being positioned between adjacent, coaxial spin chambers 62*a* and 62*b*. The spin chambers are connected alternatingly via the aforementioned offices 61 and via tangentally arranged passageways 63. Fluid enters the Lee Visco Jet orifice fitting via a passageway which leads to a first spin chamber 62*c*. It exits the spin chamber 62*c* via a tangental passageway 63 and enters another spin chamber 62*a*, which it exits via an individual orifice 61. From there the fluid enters a coaxial spin chamber 62*b* which is exited tangentially via a passageway 63 which communicates with yet another spin chamber 62*b*. This latter spin chamber 62*b* is arranged coaxially with and communicates via an orifice 61 with another spin chamber 62*a*.

This arrangement of spin chambers 62*a* and 62*b*, passageways 63 and individual orifices 61 repeats many times in a Lee Visco Jet orifice fitting 56*c*. The spin chambers, passageways and individual orifices are formed in one or more plates 58, a portion of one of which is shown in FIGS. 6*a*–6*c*. Of course, plate 58 depicted in FIGS. 6*a*–6 c is bounded by other plates or surfaces 59 adjacent its spin chambers 62*a* and 62*b* and passageways 63 to form fluid tight boundaries.

Since the pressure drop across the sleeve 40/cylinder 42 interface is taken primarily by the Lee Visco Jet orifice alone, the rate at which hydraulic fluid 32 bypasses the interface is relatively constant. Accordingly, the time in which the jarring blow is delivered after the drilling rig operator starts to withdraw the drilling string is essentially independent of the viscosity of the hydraulic fluid in the jar. Moreover, since the viscosity of hydraulic fluid is usually affected by environmental temperatures, the jar 10 will not unduly change its timing characteristics, as the jar 10 is used in the well bore 201 since the bypass fluid flow rate is essentially viscosity, and thus temperature, independent.

The major diameter of the Lee Visco Jet orifice fitting 56*c* is about 0.187 inch. Since the bypass clearance between the sleeve receiving surface 53 and sleeve 40 is nominally only 0.002 inch, the maximum diameter of hole 56*a* is almost one hundred times the aforementioned clearance. The Lee Visco Jets previously suggested for use in this application have minimum internal passageway dimensions of 0.007 to 0.010 inch. The aforementioned bypass clearance will filter particles having a dimension equal to or greater than one-fifth to one-third the minimum passageway dimension within the orifice fitting 56*c*, thereby protecting the orifice fitting 56*c* from contaminates which might otherwise clog it.

Having described my invention with regard to a specific embodiment, modification may now suggest itself to those skilled in the art. For example, clearly more than one orifice fitting may be utilized if desired. Also, the sleeve 40 could be installed on the tubular section and the cylinder 42 on the mandrel member 25 instead of the disclosed orientation of same. As a matter of design choice, I prefer the disclosed orientation since the fitting 56*c* normally requires that the member in which it is installed to be thickened, and I believe it is more economical to thicken the mandrel member 25 as opposed to the tubular member 12. Additionally, it should be self-evident that the mandrel could be operatively coupled to the drill string with the outer tubular members connected to the fish instead of the disclosed arrangement. Thus, the invention itself is not to be limited to the disclosed embodiment except as set forth in the appended claims.

I claim:

1. A for use in imparting jarring blows to an object lodged in the bore of a well, said jar comprising:

(a) a mandrel member and outer telescopically related member, said mandrel member and said tubular member movable between an extended and a collapsed of said jar;

(b) means for connecting one of said members to a drill string and the other of said members to the object to be jarred;

(c) telescopically overlapping portions of said members providing an annular chamber for confining an operating fluid;

(d) a sleeve and a cylinder extending into said chamber and into an essentially fluid tight fit with each other for a selected portion of the telescopic travel between said extended and collapsed position;

(e) a fastener for capturing said sleeve in place with respect to a first one of said members, said fastener having threads and said first one of said members having threads for receiving said fastener, the threads of a said fastener and the threads of said first one of said members having a predetermined clearance between the opposing threads thereof;

(f) an operating fluid bypass in said first one of said members, said bypass being in fluid communication with the operating fluid above and below said sleeve, said bypass including an orifice having a fluid passageway therein; and (g) filter means installed in fluid communication with an upstream of said orifice, said filter means being provided by the predetermined clearance between the threads of said fastener and the threads of said first one of said members, the maximum dimension of said predetermined clearance being less than a minimum size of the fluid passageway within said orifice.

2. The jar of claim 1, wherein said bypass includes a channel and an orifice fitting disposed in said channel, said fitting including spin chambers for imparting a rotational spin to the operating fluid therein, said spin chambers being alternatingly interconnected by individual orifices and by a plurality of passageways which are tangentially arranged between said individual orifices.

3. The jar of claim 1, wherein said mandrel member is operatively coupled to the drill string, said tubular member is operatively coupled to the object to be jarred, said sleeve is disposed on said mandrel member and said cylinder is formed on said tubular member.

4. The jar of claim 3, wherein said bypass is disposed radially inwardly of said sleeve in said mandrel member.

5. The jar of claim 4, wherein said mandrel member includes a sleeve receiving surface, said sleeve being of an annular configuration and disposed around said sleeve receiving surface at a predetermined distance therefrom, the spacing between said sleeve and said sleeve receiving surface defining an annular channel, said bypass including as a portion thereof at least a portion of said annular channel.

6. The jar of claim 5, wherein said bypass includes a hole formed in said mandrel member radially inwardly of said sleeve, said hole having maximum diameter approximately one hundred times larger than said predetermined distance.

7. The jar of claim 1, wherein said predetermined clearance follows a zig zag course longitudinally with respect to the jar as it follows the threads of said fastener and said first one of said members.

8. A jar for use in imparting jarring blows to an object lodged in the bore of a well, said jar comprising:

(a) a mandrel member and outer telescopically related tubular member, said mandrel member and said tubular member being telescopically movable between an extended and a collapsed position of said jar;

(b) means for connecting one of said members to a drill string and the other of said members to the object to be jarred;

(c) telescopically overlapping portions of said members providing an annular chamber for confining an operating fluid;

(d) a sleeve and a cylinder extending into said chamber and into an essentially fluid tight fit with each other for a selected portion of the telescopic travel between said extended and collapsed positions;

(e) a sleeve receiving surface on a first one of said members for receiving said sleeve, said sleeve receiving surface being sized to provide a predetermined passage between said sleeve and said sleeve receiving surface;

(f) a threaded member threadably engaged to said first member for capturing said sleeve thereon, there being a predetermined clearance between threads of said member and threads of said first member;

(g) an operating fluid bypass in said first one of said members, said bypass being in fluid communication with the operating fluid above and below said sleeve, said bypass including as a portion thereof said predetermined passage and an orifice having a fluid passageway therein; and (h) filter means installed in fluid communication with an upstream of said orifice, said filter means being provided by the predetermined clearance between the threads of said fastener and the threads of said first one of said members, the maximum dimension of said predetermined clearance being less than a minimum size of the fluid passageway within said orifice.

9. The jar of claim 8, wherein said bypass includes a channel and orifice is an orifice fitting disposed in said channel, said fitting including spin chambers for imparting a rotational spin to the operating fluid therein, said spin chambers being alternatingly interconnected by individual orifices and by a plurality passageways tangentially arranged between said individual orifices.

10. The jar of claim 8, wherein said mandrel member is operatively coupled to drill string, said tubular member is operatively coupled to the object to be jarred, said sleeve is disposed on said mandrel member and said cylinder is formed on said tubular member.

11. The jar of claim 11, wherein said bypass is disposed radially inwardly of said sleeve in said mandrel member.

12. The jar of claim 11, wherein said bypass includes a hole formed in said mandrel member radially inwardly of said sleeve, said hole having a maximum diameter approximately one hundred times larger than said predetermined passage.

13. The jar of claim 12, further including a threaded fastener for capturing said sleeve in place with respect to said mandrel member, the threads of a said fastener and the threads of said mandrel member having a predetermined gap, said predetermined gap forming a portion of said bypass.

14. A jar for use in imparting jarring blows to an object lodged in the bore of a well, said jar comprising:

(a) a mandrel member and outer telescopically related tubular member, said mandrel member and said tubular member being telescopically movable between an extended and a collapsed position of said jar, a first one of said members having a sleeve receiving surface;

(b) means for connecting one of said members to a drill string and the other of said members to the object to be jarred;

(c) telescopically overlapping portions of said members providing an annular chamber for confining an operating fluid;

(d) an annular sleeve and a cylinder extending into said chamber and into an essentially fluid tight fit with each other for a selected portion of the telescopic travel between said extended and collapsed positions, said sleeve being disposed around said sleeve receiving surface at a predetermined distance therefrom, the spacing between said sleeve and said sleeve receiving surface defining an annular channel;

(e) an operating fluid bypass in fluid communication with the operating fluid above and below said sleeve and in fluid communication with said annular channel;

(f) an orifice fitting disposed in said bypass, said fitting including spin chambers for imparting a rotational spin to the operating fluid therein, said spin chambers being alternatingly interconnected by individual orifices and tangentially arranged fluid passageways, said orifice fitting generating a high, different pressure when said jar is being set;

(g) said bypass including filtering means distinct from said fitting provided by at least a portion of said annular channel and disposed upstream of said fitting when said jar is being set.

15. The jar of claim 14, wherein said mandrel member is operatively coupled to the drill string, said tubular member is operatively coupled to the object to be jarred, said sleeve is disposed on said mandrel member and said cylinder is formed on said tubular member.

16. The jar of claim 15, wherein said bypass is disposed radially inwardly of said sleeve.

17. A jar for use in imparting jarring blows to an object lodged in the bore of a well, said jar comprising:

(a) a mandrel member and outer telescopically related tubular member, said mandrel member and said tubular member being telescopically movable between an extended and a collapsed position of said jar, a first one of said members having a sleeve receiving surface;

(b) means for connecting one of said members to a drill string and the other of said members to the object to be jarred;

(c) telescopically overlapping portions of said members providing an annular chamber for confining an operating fluid;

(d) an annular sleeve and a cylinder extending into said chamber and into an essentially fluid tight fit with each other for a selected portion of the telescopic travel between said extended and collapsed positions, said sleeve being disposed around said sleeve receiving surface at a predetermined distance therefrom, the spacing between said sleeve and said sleeve receiving surface defining an annular channel;

(e) an operating fluid bypass in fluid communication with the operating fluid above and below said sleeve and in fluid communication with said annular channel;

(f) an orifice fitting disposed in said bypass, said fitting including spin chambers for imparting a rotational spin to the operating fluid therein, said spin chambers being alternatingly interconnected by individual orifices and tangentially arranged fluid passageways;

(g) said bypass including filtering means distinct from said fitting provided by at least a Portion of said annular channel; and (h) a threaded fastener for capturing said sleeve in place with respect to said mandrel member, the threads of said fastener and the threads of said mandrel member having a predetermined gap, said predetermined gap forming at least a portion of said filtering means.

* * * * *